US005189966A

United States Patent [19]

Satterfield

[11] Patent Number: 5,189,966

[45] Date of Patent: Mar. 2, 1993

[54] TUFTING APPARATUS AND METHOD FOR FORMING LOOP PILE

[75] Inventor: William H. Satterfield, Dalton, Ga.

[73] Assignee: Spencer Wright Industries, Inc., Dalton, Ga.

[21] Appl. No.: 874,065

[22] Filed: Apr. 24, 1992

[51] Int. Cl.[5] ..... D05C 15/22; D05B 85/00

[52] U.S. Cl. ..... 112/80.53; 112/222; 112/266.2

[58] Field of Search ..... 112/222, 224, 266.2, 112/80.01, 80.16, 80.5, 80.52, 80.53; 223/102

[56] References Cited

U.S. PATENT DOCUMENTS

| | | | |
|---|---|---|---|
| 29,648 | 8/1860 | Drake | 112/222 |
| 151,558 | 6/1874 | Blanchard | 112/222 |
| 190,475 | 5/1877 | Dawson | 112/222 |
| 202,237 | 6/1878 | Cross | 112/222 |
| 216,141 | 6/1879 | Bridge | 112/222 |
| 228,446 | 6/1880 | Cross | 112/222 |
| 3,397,660 | 8/1965 | Luther | 112/222 |
| 3,896,750 | 7/1975 | Amos | 112/222 |
| 4,195,584 | 4/1980 | Falk et al. | 112/222 |

FOREIGN PATENT DOCUMENTS

| | | | |
|---|---|---|---|
| 808956 | 3/1969 | Canada | 112/222 |
| 931171 | 2/1948 | France | 112/222 |
| 1433041 | 2/1966 | France | 112/222 |
| 434943 | 10/1967 | Switzerland | 112/222 |
| 1002081 | 8/1965 | United Kingdom | 112/222 |

*Primary Examiner*—Clifford D. Crowder
*Assistant Examiner*—Paul C. Lewis
*Attorney, Agent, or Firm*—Alan Ruderman

[57] ABSTRACT

A tufting machine has a plurality of needles, each needle having a pair of eyes and cooperating with a pair of loop pile loopers seizing loops of yarn from a respective eye. The needle has an elongated yarn receiving groove extending along the surface of the needle facing the direction in which backing material is being fed. Each eye opens into the groove for receiving yarn guided along the groove. The point of the needle is offset relative to the longitudinal axis of the needle so that the needle does not enter loops previously shed by the loopers when relatively high pile height fabric is produced. The loopers of each pair of loopers have bills which point in the direction the backing material is being fed, the bills converging in the direction in which they point. The loopers of each looper pair are laterally spaced apart and each looper of the pair enters a clearance above a respective eye for seizing loops of yarn presented through the eye. The needle and the looper pair cooperate to form a series of loop pile loops in a row which form a non-aligned array resulting in a non-linear appearance of the loops.

19 Claims, 2 Drawing Sheets

TUFTING APPARATUS AND METHOD FOR FORMING LOOP PILE

BACKGROUND OF THE INVENTION

This invention relates to tufting machines and tufted fabrics, and more particularly to a needle and looper apparatus cooperating with the needle for producing a new tufted loop pile fabric having the loops in a non-linear array.

In the production of tufted fabrics a plurality of spaced apart yarn carrying needles extend transversely across the machine and are reciprocated cyclically to penetrate and insert loops of yarn into a backing material fed longitudinally through the machine. The loops are seized by respective loopers or hooks oscillating below the backing material in timed relationship with the needles as the loopers or hooks cross the needles just above the needle eye. Although there are some needles which have two eyes through which yarn is threaded and which throws off loops seized by a single looper, such as described in Falk et al U.S. Pat. No. 4,195,584, substantially all tufting needles in the prior art have but a single eye. In loop pile machines the loopers point in the direction of feed of the backing material and hold the seized loops while the needles are retracted from the backing material, the loopers thereafter rocking away from the point of loop seizure to release the loops. When the needles start their next descent the loops have been released from the loopers and carried one stitch length away from the needle path. In cut pile machines the hooks point in the direction opposite to the direction to which the backing material is fed so that the loops are fed onto the hooks and each hook cooperates with the respective oscillating knife to cut the loops therein in seriatim.

Although the pile height of cut pile fabric depends solely upon the distance that the hooks are disposed beneath the backing material, the pile height of loop pile fabrics depends on the amount of yarn fed to the needle with the maximum being the distance from the loopers to the backing material. However, if the loopers are spaced too far from the backing material, the loops produced may be so large that during the next needle penetration the needle enters the previously formed loop thereby resulting in a chain stitch similar to the chain stitch produced by a sewing machine. This of course limits the aesthetics of the fabric produced and thus the pile height of loop pile fabrics is limited to relatively low pile heights.

Additionally, a looper may be a right hand or left hand type for cooperating with a corresponding type needle having a clearance above the eye across which the looper crosses disposed either on the right side or the left side as viewed from behind the looper in the direction of fabric feed. Generally a right hand looper is used when tufting S-twist or left twist yarn, and a left hand looper is used when tufting Z-twist or right twist yarn. This reduces the curling effect of the tufted loops.

Because of the nature of the loop forming methods of the prior art the loops formed by each needle are aligned in the direction of fabric feed. Thus, when viewing a loop pile fabric, the alignment of the loops can readily be seen as rows extending in the longitudinal direction of the fabric. The aesthetic appearance of such fabric has thus been limited in the prior art. Thus, although loop pile fabric has better wear characteristics than cut pile fabric, the aesthetics, including the low pile height, have limited the selection of loop pile fabric to only certain environments such as high usage areas. Moreover, albeit the straight lines of rows, i.e., the corn cob effect, may be broken up by laterally or transversely shifting the needles in a to and fro motion, the alignment of the loops has not been overcome in the prior art.

SUMMARY OF THE INVENTION

Consequently, the primary object of the present invention is to provide a needle for use with tufting apparatus which may produce loop pile fabric having the loops in a nonaligned array.

It is another object of the present invention to provide a needle cooperable with tufting machine looper apparatus, the needle having two eyes through which a separate respective yarn strand is threaded, the needle cooperating with two loop pile loopers, each looper seizing the yarn from a respective eye.

It is a further object of the present invention to provide a tufted loop pile fabric having a backing material in which at least two separate yarns form the backstitch extending between adjacent longitudinally spaced apart needle penetration holes, and the face of the fabric has at least a pair of loops projecting from each needle penetration hole, each loop of each pair of loops being nonaligned with the other loop of the pair and nonaligned with the loops projecting from the adjacent needle penetration hole so that the loops provide a non-linear array on the face of the fabric.

It is a still further object of the present invention to provide a method for tufting loop pile fabric wherein the loops formed by the same needle in a row of loops are not aligned.

It is yet a still further object of the present invention to provide a method of tufting loop pile fabrics including inserting at least a pair of yarns into a backing material by a single needle and seizing the yarn of each pair by a different looper of a pair of loopers straddling the needle beneath the backing material.

Accordingly, the present invention provides a needle for cooperating with a pair of loop pile loopers, the needle having a pair of eyes. At least one strand of yarn is threaded through each eye for seizure by a respective looper of the pair. The needle is formed with a point at one end and a mounting shank at its other end. The eyes are spaced apart laterally adjacent the point end and a yarn receiving groove extends along one elongated surface and opens into each eye for guiding at least one yarn strand into each eye. Preferably the point is offset relative to the center-line of the needle and the eyes.

The needle is reciprocated into and out of loop seizing relationship with the pair of loopers. The loopers of the looper pair are laterally spaced apart and each looper enters a clearance above the respective eye for seizing loops of yarn presented through the eye. The loopers have bills which point in the direction backing material is fed toward the needle, one looper of the pair being a right hand looper and the other being a left hand looper, and the bills converge in the direction in which the bills point. The needle during its reciprocating cycle enters the space between the converging bills and presents at least one loop from each eye, each loop being seized by the cooperating looper entering the respective clearance above the eye. As the needle is withdrawn from the loop seizing relationship with the loopers, and the loopers retract from that disposition, the loops are shed by the loopers. As the process continues the needle and the looper pair form a series of loops in a row, and the loops, at least when the yarns are of the same twist type, form a nonaligned array which results in a non-linear appearance of the loops. When a plurality of said needles are disposed in laterally spaced apart disposition in a tufting machine, each cooperating with a respective pair of loopers, the tufting machine produces a loop pile fabric having an aesthetic appearance not heretofore produced.

With the point of the needle offset relative to the center-line of the needle in the direction opposite to that which the backing material is fed, chain stitching is avoided even when relatively high pile height loops are produced, and this provides an even more attractive and a very sturdy long lived fabric. When small denier sized yarns are utilized and more than one yarn is threaded through each eye, unique and aesthetically attractive fabrics may be produced.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
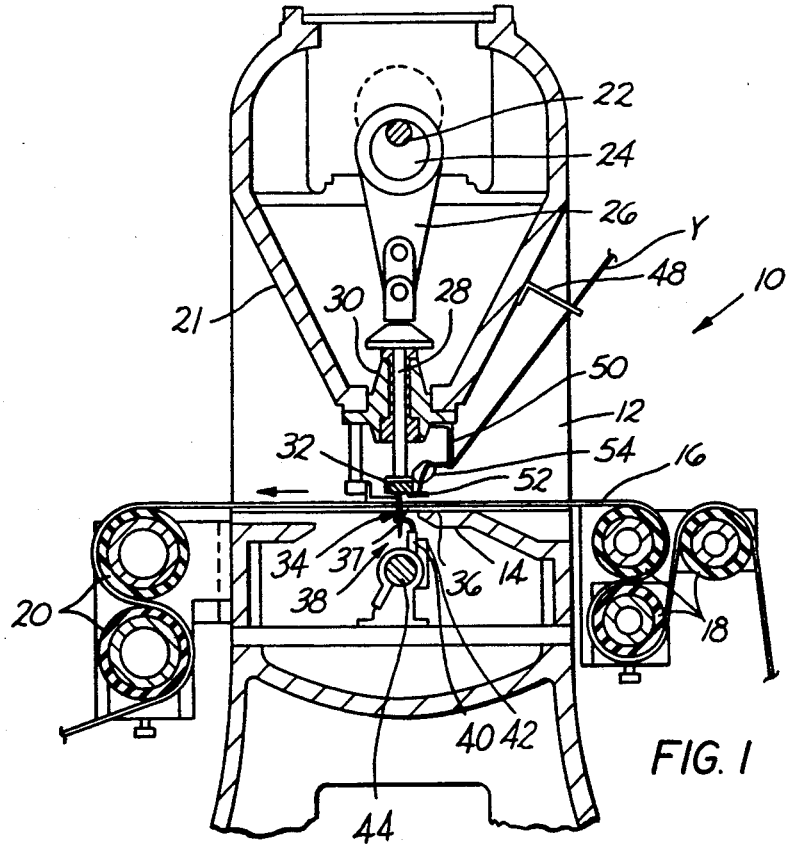
FIG. 1 is a vertical cross sectional view taken transversely through a loop pile tufting machine incorporating apparatus constructed in accordance with the principles of the present invention.

Referring now to FIG. 1 of the drawings, the present invention is disclosed as embodied in a loop pile tufting machine 10 having a frame 12 including a bed plate 14 over which backing material 16 is fed by feed means comprising backing material supply feed rollers 18 at the supply side and tufted fabric output rollers 20 at the exit side of the machine. Journally supported transversely of the frame 12 in the head 21 is a rotatably driven mainshaft 22 on which a plurality of eccentrics 24 are secured, only one of the eccentrics being illustrated in the drawings. A link 26 having its upper end secured about the respective eccentric is connected at its lower end to a push rod 28, each push rod being mounted for endwise reciprocation within a respective bushing 30 carried in the head 21. Mounted on the lower ends of the push rods 28 is a needle bar 32 having a plurality of needles 34 constructed in accordance with the principles of the present invention mounted therein. The needles are thus reciprocated to penetrate through the backing material 16 and a needle plate 36 supported on the bed plate 14, the needle plate having a plurality of spaced apart fingers 37 between which the respective needles reciprocate. The needles cooperate with looper means 38 beneath the backing material arranged in accordance with the present invention, the looper means, as hereinafter described, comprising two loopers cooperating with each needle. The loopers are mounted in a looper support block 40, which preferably are modular units, secured to a bracket 42 clamped about an oscillating looper shaft 44 beneath the bed plate 14.

Figure 7:
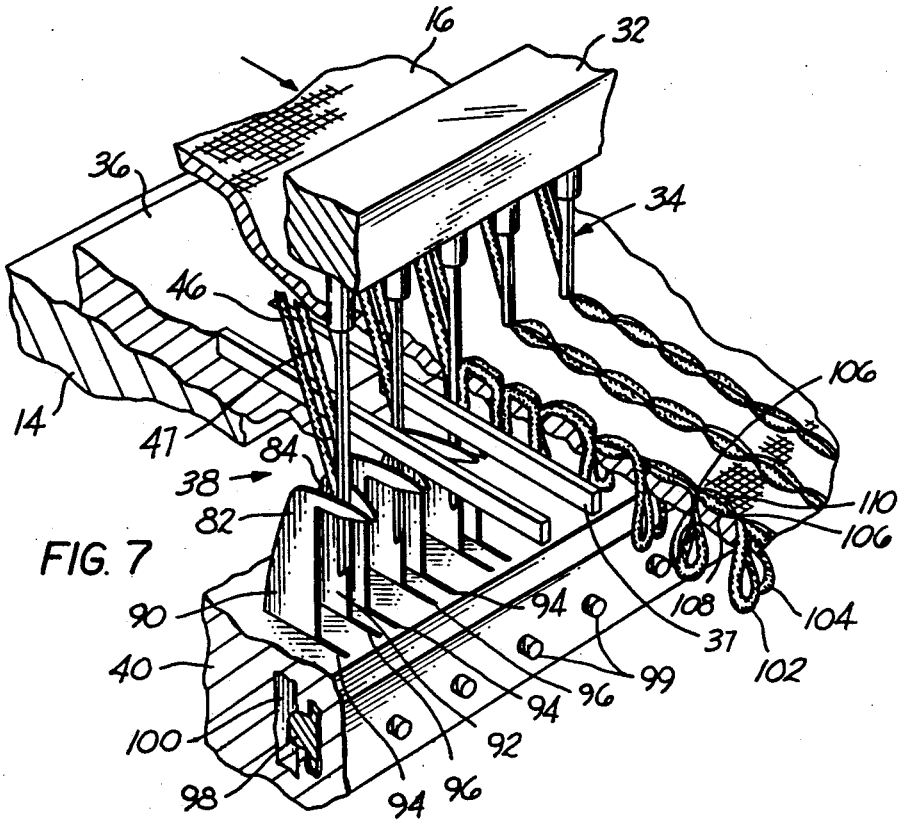
FIG. 7 is a perspective view of the loop forming instrumentalities of the present invention including needles as illustrated in FIG. 2, and cooperating loopers.

Yarn Y fed from a source such as a creel (not illustrated) is fed to each needle 34, and in accordance with the present invention at least two strands of yarn 46, 47, illustrated in FIG. 7, are fed to each needle from the supply through yarn guides 48, 50 and 52, there being a yarn jerker bar 54 carried by the needle bar 32 for pulling yarn from yarn feed means (not illustrated) disposed between the supply and the guide 48. With the exception of the needles and the loopers, the construction of the tufting machine is conventional and is well known to those in the art. Accordingly, further description of the tufting machine is unnecessary for an understanding of the present invention by those skilled in the art.

Figure 2:
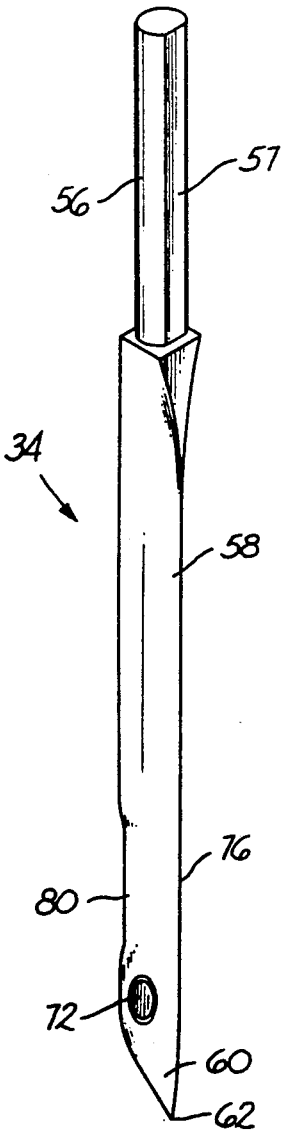
FIG. 2 is a front perspective view of a needle formed in accordance with the principles of the present invention.
Figure 4:
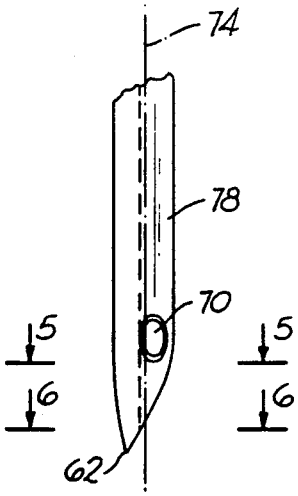
FIG. 4 is a fragmentary elevational view of the needle.
Figure 5:
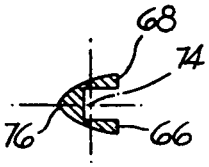
FIG. 5 is a cross-sectional view taken substantially along line 5—5 of FIG. 4.
Figure 6:
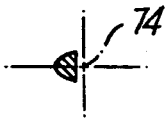
FIG. 6 is a cross sectional view taken substantially along line 6—6 of FIG. 4.
Figure 3:
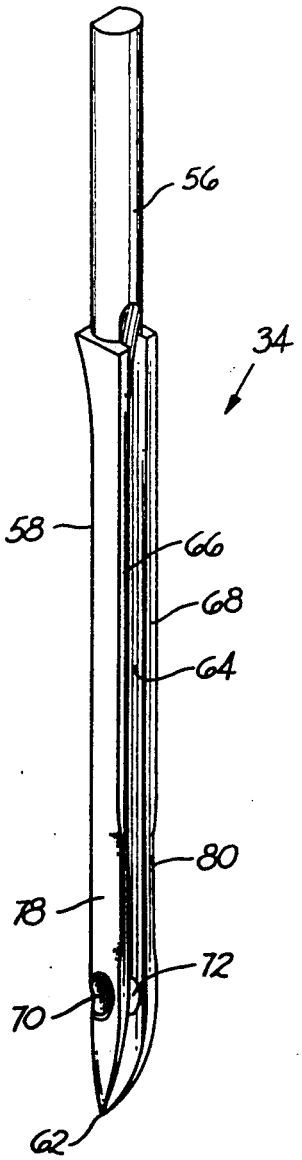
FIG. 3 is a rear perspective view of the needle illustrated in FIG. 2.

Referring now to FIGS. 2 and 3, each needle 34 comprises an elongated unitary body member having a shank 56 at the uppermost portion, preferably of a cylindrical configuration, but including a mounting flat 57, adapted to be securely mounted in the needle bar 32 of the tufting machine. A blade portion 58 is disposed intermediate the flank 56 and a point portion 60 is formed at the lower end of the needle, the point portion terminating in a point or tip 62. Extending along one side of the blade 58 from the shank to a disposition at least down to the eyes, as hereinafter described, is a yarn guide groove 64. The groove 64 is substantially deeper than conventional tufting machine needles, the depth of the groove 64 being such that the groove has a substantially U-shaped configuration with the legs thereof defining a pair of spaced apart flanks 66 and 68. Formed in each flank 66, 68 is a respective eye 70, 72 for receiving a respective yarn strand 46, 47 as illustrated in FIG. 7.

As illustrated in the figures the point portion 60 including the point 62 is formed off-set from the center-line 74 of the blade and shank. This results from forming the eyes in the flanks and ensuring sufficient material available to form the point, and also provides a needle which will not enter the loop of yarn previously formed when the needle is reciprocated through the backing material to produce the subsequent loop. Tufting needles having offset points are believed to be known and do not per se form a part of the present invention. However, the present invention readily effects such an offset point. The two flanks 66, 68 are joined at the exterior surface in a substantially Vee-shaped nose 76 which, when the needle is disposed in the looper block 40, faces in the direction opposite to which the backing material 16 is fed, i.e., the groove 64 and the flanks face toward the direction in which the backing material is fed and the Vee-nose faces the direction from which the backing material has been fed.

Each flank 66, 68 includes a respective clearance 78, 80 formed as a slight recess in the surface of the respective flank above the respective eye 70, 72. A clearance is known in the art with respect to conventional needles as the "clearance above the eye" or C.A.E. and provides the space or clearance for receiving a tufting machine looper on the downstroke of the needle after penetration of the backing material as the looper is oscillated forwardly to cross the needle path. With the needle of the present invention, each C.A.E. receives a respective looper 82, 84 of the looper means 38.

Figure 8:
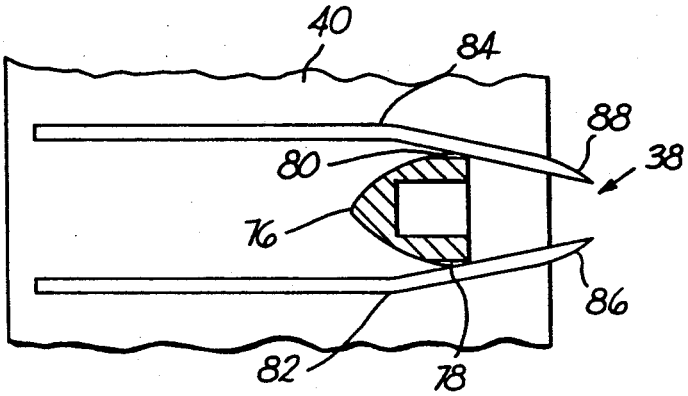
FIG. 8 is a fragmentary top plan view partly in section illustrating the disposition of the loopers of FIG. 4.

As illustrated in FIGS. 7 and 8, the looper 82 is a right hand (R.H.) looper acting at the right side of the needle and received within the C.A.E. 78 while the looper 84 is a left hand (L.H.) looper acting at the left side of the needle and received within the C.A.E. 80, the right and left side being determined from behind the looper and looking in the direction in which the backing material is fed. The loopers 82 and 84 have bills 86, 88 respectively which converge toward each other either by being curved or, preferably, bent, each looper also including a neck terminating at a respective mounting shank 90, 92 received within respective slots 94, 96 in the block 40, the loopers being secured by a clamping bar 98 movable within a slot 100 and acted upon by screw means forced against the lower end of the mounting shank of the loopers. Because two loopers 82 and 84 cooperate with each needle 34, on opposite sides thereof, the looper receiving slots corresponding to each needle are further apart than each adjacent looper receiving slot corresponding to the adjacent needles, i.e., slot 94 receiving a looper 82 for each needle is further from slot 96 receiving the looper 84 for that needle than the adjacent slot 96 receiving a looper for the adjacent needle, and the same is true with respect to the slots 96. Thus, unless extremely course gauge fabric is to be produced, the looper receiving slots for adjacent needles are closer together than the looper receiving slots for the same needle as illustrated in FIG. 7.

The reciprocation of the push rod 28 and thus the needles 34 and the oscillation of the looper shaft 44 and thus the loopers 82, 84 is conventional and results in the loopers rocking back and forth relative to the reciprocating path of the needles. When the needles descend and have penetrated the backing 16, the loopers move forwardly and cross the needles, the loopers 82, 84 entering the respective C.A.E. 78, 80. Thus, as the needle begins to ascend, each yarn 46, 47 threaded through the respective eye 70, 72 presents a respective loop 102, 104 which is seized and held by the respective looper 82, 84 as the needle continues to ascend. As the needles reach the top of their stroke, the loopers release or shed the loops as they rock back away from the needle reciprocating path and as the loops are carried forwardly due to the feeding of the backing material. Thus, each needle and the cooperating loopers act to form a pair of loops. If desired, more than one yarn strand may be threaded through each eye 70, 72, the yarn strands threaded through each eye being seized and then shed by each respective looper. In that case it may be desirable to use smaller diameter yarn strands. In any event all of the loops formed by each needle 34 and the cooperating loopers 82, 84 during one needle penetration of the backing extends from a single needle penetration hole 106.

Figure 9:
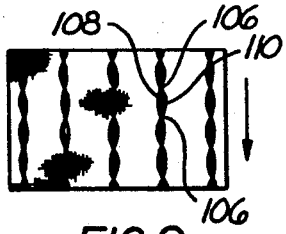
FIG. 9 is a diagrammatic view of the backstitch of a loop pile fabric of the present invention.
Figure 10:
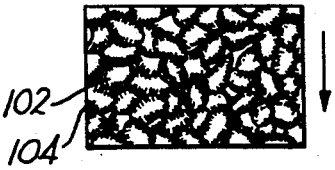
FIG. 10 is a diagrammatic view of the face of a loop pile fabric of the present invention.

When there are but two yarns 46, 47 forming the loops 102, 104, there are also two backstitches 108, 110 extending on the back of the backing material 16 between successive adjacent needle penetration holes 106 as illustrated in FIGS. 7 and 9. Thus, each needle during successive penetrations of the backing material forms a row of backstitches having two or more yarn strands. When both yarns 46 and 47, or all the yarns when more than two yarns are threaded through the respective needle eyes, are of the same type, such as either S-twist or Z-twist, at least one of the loops extending from each penetration hole 106 twists away from the other. In doing so it appears that it pushes the other loop so that both loops twist differently out of the normal disposition of loop pile loops in the fabric produced. This creates a non-linear look having a somewhat random disposition of the loops and a pleasing aesthetic appearance to the pile on the face of the fabric. The appearance is similar to the look of "Persian lamb" or "Astrakhan." When a relatively high pile height fabric is produced, an attractive highly durable product results. When more than one yarn is threaded through each eye of the respective needle, other attractive durable fabrics may be produced. Additionally, variations in yarn type including threading an S-type yarn and a Z-type yarn through the respective eyes of a single needle, may result in other more pleasing fabrics.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A needle for tufting including a shank having a longitudinal axis, a blade extending from said shank to a point portion terminating in a tip, said blade having an elongated groove formed along one surface and defining a pair of spaced apart flanks on opposite sides of said groove, an eye extending transversely through each flank opening into said groove above said tip, whereby at least a first and a second yarn strand may be guided along said groove for guiding said first yarn strand through one eye and said second yarn strand through the other eye.

2. A needle as recited in claim 1, wherein said flanks converge toward a surface remote from said groove to define an elongated nose extending along said blade to said point portion and terminating at said tip.

3. A needle as recited in claim 2, wherein said tip is offset relative to said longitudinal axis toward said nose.

4. A needle as recited in claim 1, wherein said blade includes a recess formed above each eye defining a clearance in each flank above a respective eye.

5. A needle as recited in claim 4, wherein said flanks converge toward a surface remote from said groove to define an elongated nose extending along said blade to said point portion and terminating at said tip.

6. A needle as recited in claim 5, wherein said tip is offset relative to said longitudinal axis toward said nose.

7. A needle as recited in claim 2, wherein each eye is offset relative to said longitudinal axis away from said nose.

8. A needle as recited in claim 7, wherein said tip is offset relative to said longitudinal axis toward said nose.

9. A needle as recited in claim 7, wherein said blade includes a recess formed above each eye defining a clearance in each flank above a respective eye.

10. A needle as recited in claim 9, wherein said tip is offset relative to said longitudinal axis toward said nose.

11. In a tufting machine having a reciprocable needle bar, a plurality of needles mounted in said needle bar for penetrating and carrying yarn through a backing material fed in one direction through the machine, each of said needles comprising a shank having a longitudinal axis mounted in said needle bar, a blade extending from said shank to a point portion terminating in a tip, said blade having an elongated groove formed in a surface facing said one direction and defining a pair of spaced apart flanks on opposite sides of said groove, an eye extending transversely through each flank opening into said groove above said tip, each eye receiving at least one yarn strand guided along said groove into each said eye, oscillatable looper support means, a plurality of loopers mounted in said looper support means and oscillatable therewith, each looper having a bill pointing in said one direction, two of said loopers being disposed in said looper support means adjacent the reciprocating path of each needle, the bills of said two loopers converging toward each other, one of said two loopers being disposed for seizing loops of yarn presented by said needle from one of said eyes and the other of said loopers being disposed for seizing loops of yarn presented by said needle from the other of said eyes during a portion of the oscillation of said looper support means and for shedding said loops during another portion of the oscillation of said looper support means to form at least two loop pile loops.

12. In a tufting machine as recited in claim 11, wherein said flanks converge toward a surface remote from said groove to define an elongated nose extending along said blade to said point portion and terminating at said tip, said nose facing in a direction opposite to said one direction.

13. In a tufting machine as recited in claim 12, wherein said tip is offset relative to said longitudinal axis toward said nose.

14. In a tufting machine as recited in claim 11, wherein said blade includes a recess formed above each eye defining a clearance in each flank above a respective eye, one of said loopers entering one of said clearances and the other of said loopers entering the other of said clearances for seizing loops of yarn.

15. In a tufting machine as recited in claim 14, wherein said flanks converge toward a surface remote from said groove to define an elongated nose extending along said blade to said point portion and terminating at said tip, said nose facing in a direction opposite to said one direction.

16. In a tufting machine as recited in claim 15, wherein said tip is offset relative to said longitudinal axis toward said nose.

17. A method of tufting loop pile fabric comprising reciprocating a needle having two eyes along a path from one side through another side of a backing material fed in one direction, supplying separate yarn strands to each eye, oscillating a pair of loopers at said other side of said backing material toward and away from said path, seizing a loop of yarn by one of said loopers presented by said needle from one of said eyes, and seizing another loop of yarn by the other of said loopers presented by said needle from the other of said eyes.

18. A method of tufting as recited in claim 17, wherein the yarn supplied to each eye is of the same twist type.

19. A method of tufting loop pile fabric comprising reciprocating a needle having two eyes along a path from one side to the other side of a backing material fed in one direction, supplying separate yarn strands to each eye, oscillating a first looper at said other side of said backing material toward and away from said path for seizing a loop of yarn presented by said needle from one of said eyes, and oscillating a second looper at the other side of said backing material toward and away from said path for seizing a loop of yarn presented by said needle from a second of said eyes.

* * * * *